US006159025A

United States Patent [19]

Derman

[11] Patent Number: 6,159,025

[45] Date of Patent: Dec. 12, 2000

[54] ELECTRIC CORD PLUG LOCK

[76] Inventor: Jay S Derman, P.O. Box 3823, Palos Verdes, Calif. 90274-9533

[21] Appl. No.: 09/500,055

[22] Filed: Feb. 8, 2000

[51] Int. Cl.[7] ..... H01R 13/44

[52] U.S. Cl. ..... 439/134

[58] Field of Search ..... 439/133, 134

[56] References Cited

U.S. PATENT DOCUMENTS

| | | | |
|---|---|---|---|
| 3,416,123 | 12/1968 | Husebo | 439/134 |
| 3,422,389 | 1/1969 | Husebo | 439/134 |
| 5,176,527 | 1/1993 | Herbert | 439/134 |
| 5,398,530 | 3/1995 | Derman | 439/133 |

*Primary Examiner*—Neil Abrams
*Attorney, Agent, or Firm*—Monty Koslover

[57] ABSTRACT

A locking device for preventing an end plug on an equipment from being connected to a source of current or preventing equipment theft. The device is a small, rigid plastic body that includes a receptacle to plug in either a three-pronged or two pronged plug, and includes internal means to engage and secure the plug prongs by using a floating pin that engages a hole in the prong tips. The device is locked by passing a cable, shaft or a padlock shackle through a passage in it, and may be secured by locking the cable, shaft or padlock shackle to a post. A multiple number of devices may be secured using one cable.

6 Claims, 3 Drawing Sheets

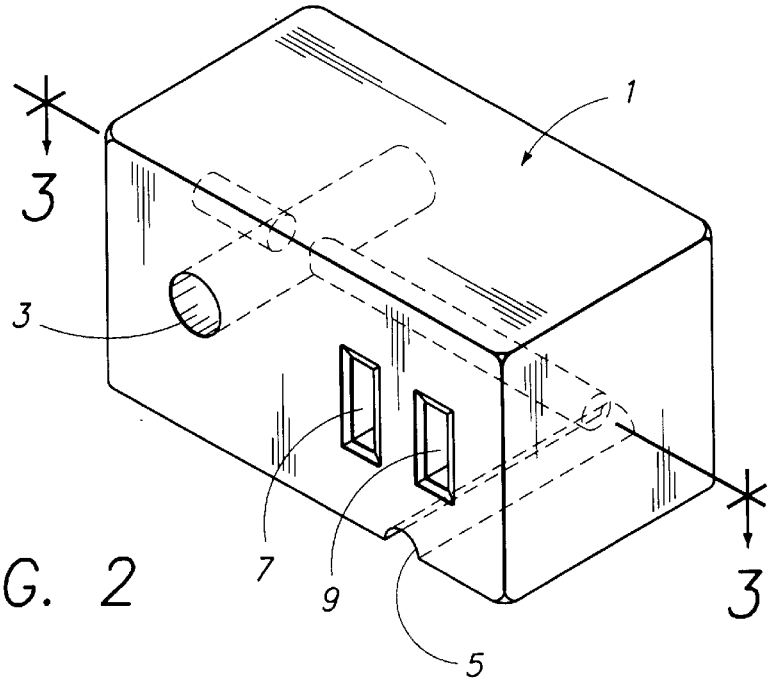
FIG. 2
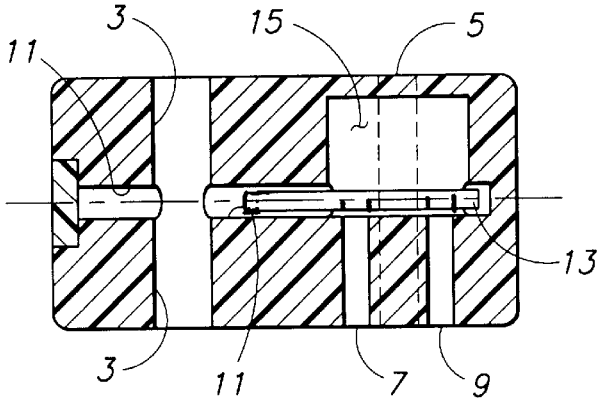
FIG. 3
FIG. 4
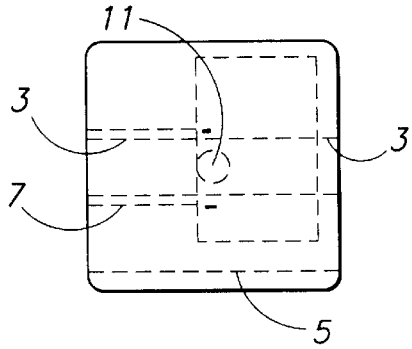
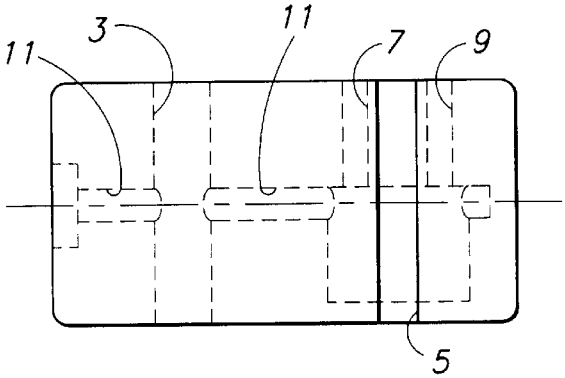
FIG. 5

ELECTRIC CORD PLUG LOCK

BACKGROUND OF THE INVENTION

1. Field of the Invention

This invention relates to devices for securing small portable, electric powered equipment from theft or unauthorized use, and more particularly to a device for securing an equipment by use of its power plug.

2. Background

At times, unauthorized individuals should not be allowed to use equipment connected to a source of electrical current. This is occasionally the case in small business offices and sometimes in the home, where electrical appliances are used. In stores selling and displaying small electrical appliances and equipments such as PC's, there is an ongoing problem of securing these appliances and equipments from easy and quick theft. This problem is typically being solved by various locking arrangements, few of which are simple and inexpensive.

There is therefore a need for a simple and inexpensive device that can be used to prevent unauthorized use or theft of electrical powered equipment.

SUMMARY OF THE INVENTION

The invention device is a small, rigid plastic body that incorporates a plug receptacle for a standard power plug that is attached to an equipment, and means for securing and locking the plug to the device. The plug, which has an opening in the tips of two prongs, is secured by a floating pin contained in an internal passage, that is caused to fall into the prong openings by tilting the device. A second passage in the body intersects with the first passage and may have a wire cable, a shaft, or a padlock shackle passed through the passage, resulting in the device being locked to the power plug. Use of a cable, shaft or a padlock shackle provides a means of securing the plug and its attached power equipment from theft. A multiple number of devices and attached equipments may be secured with a single wire cable or shaft. An alternate embodiment includes a cam lock mounted in the second passage that acts to lock the floating pin in place and lock the plug to the device, preventing unauthorized use of an equipment.

It is therefore a prime object of this invention to provide a simple method of securing an electrical equipment from unauthorized use.

Another object of this invention is to provide an inexpensive device for securing one or more electrical equipments from theft.

An advantage of this invention over other locking devices is in its small size and easy applicability to many types of equipments and appliances.

Further objects and advantages of the invention will be apparent from studying the following portion of the specification, the claims and the attached drawings.

BRIEF DESCRIPTION OF THE DRAWINGS

FIG. 2 is a perspective view of the preferred embodiment device according to the present invention, particularly showing two plug prong openings and a bored through hole for attaching a cable or other suitable locking device;

FIG. 3 is a cross-section plan view of the present invention taken along line 3—3 of FIG. 2, particularly showing a free moveable locking pin located in a central axis channel and the pin's relationship to the plug prong openings and through hole;

FIG. 4 is an end elevation view of the device according to the present invention;

FIG. 5 is a bottom view of the plug lock device, particularly showing the location of a surface groove for holding the grounding terminal of a three-pronged plug;

DESCRIPTION OF THE PREFERRED AND ALTERNATE EMBODIMENTS

The invention is a device that is primarily intended for locking an equipment power plug so that it can not be plugged in a power outlet to energize the equipment. The device is also intended to protect the equipment from theft and unauthorized removal.

Figure 1:
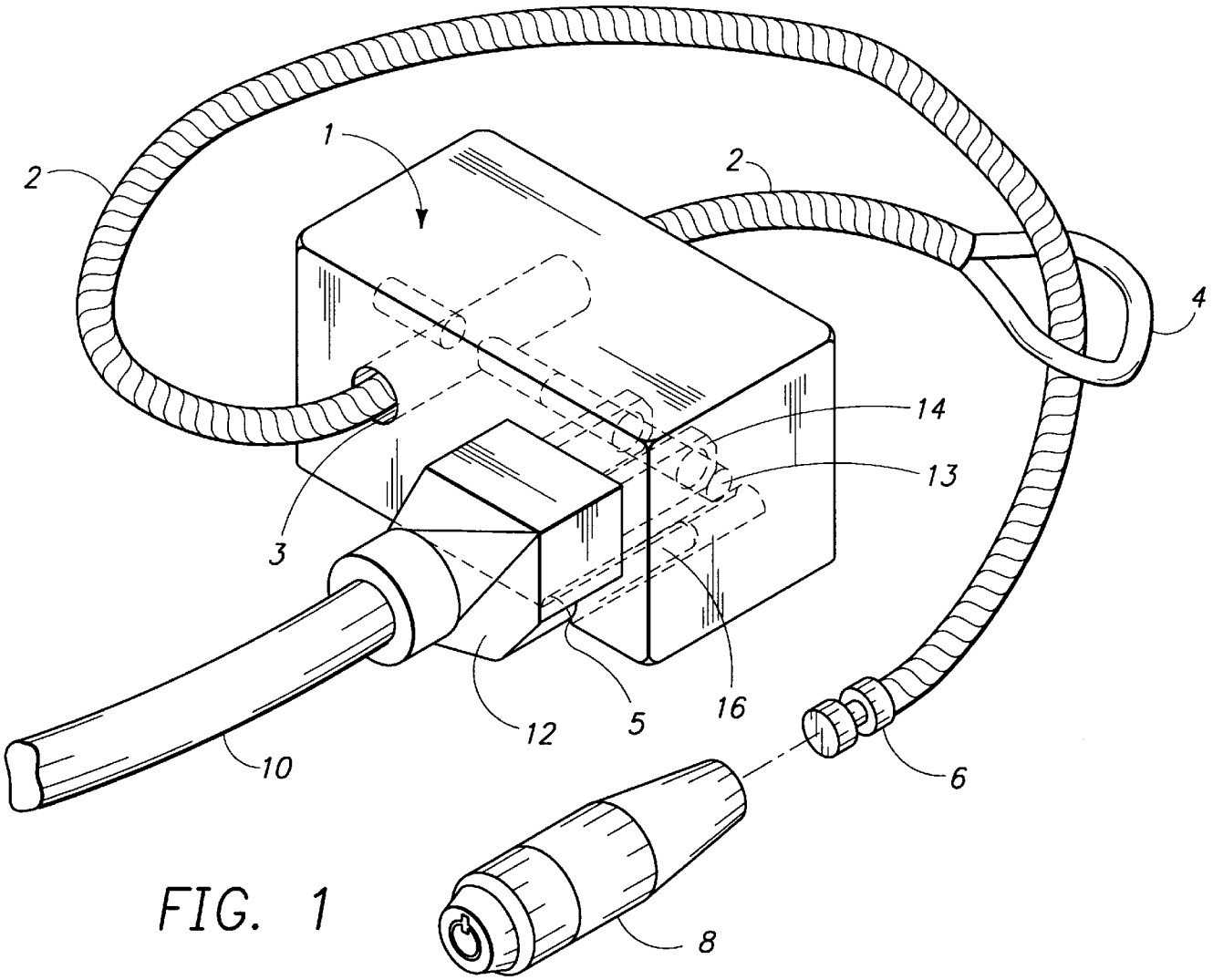
FIG. 1 is a perspective view of a preferred embodiment of the present invention electric cord plug lock 1 device, showing an equipment power cord with a three pronged plug connected to the device and a cable attached to the device for locking and securing the equipment to a suitable fixture.

Refer now to FIG. 1. FIG. 1 shows an electric cord plug lock device 1 with an equipment power cord 10 and three-pronged plug 12 plugged into a receptacle formed in the device 1. In this illustration, a wire cable 2 is passed through a cross-axial passage 3 that is perpendicular (90 deg.) to the longitudinal axis in the plug lock device 1, the cable ferrule end 6 is passed through a loop end 4, cable ferrule end 6 may then be inserted in a shaft lock preventing the cable end from being pulled back through loop 4. The cable 2 would typically be passed around a fixed, immovable post or other fixture for securing before passing the ferrule end through the loop end 4.

Two parallel prongs of the inserted three prong power plug 12 each have a circular hole 14 in their tips. The third prong 16 which is for grounding, fits in a groove 5 in the bottom surface of the device 1. Located axially inside the device is a floating pin 13 that drops by gravity through the holes 14 in the two parallel prongs when the device 1 is tilted on end. When a cable 2 or rod is inserted in the cross-axial passage 3, the pin 13 is blocked from sliding out of the holes in the plug prong tips. The plug 12 thus remains locked to the device 1.

In this device embodiment, the cross-axial passage 3 with the cable through it, is shown horizontal and parallel with the plug prong openings. However, this is merely an example configuration. The passage 3 and a blocking member inside it would work just as well if rotated and located 90 degrees around the pin 13 and device axis and may be constructed in that configuration.

As an alternative, a shaft or a padlock shackle may be used in place of a wire cable to pass through the cross-axial passage 3 and perform the floating pin 13 blocking function. This is at the discretion of the device user.

It should be noted that multiple locking devices and equipment power plugs can be secured by a single cable, by passing the cable through the cross-axial passage 3 in each device before locking and securing the cable. This is particularly suitable for securing a number of equipments that are attached to electrical cords.

Refer now to FIGS. 2, 3, 4 and 5 which are respectively, a perspective view of the preferred embodiment according to the present invention, a cross-section view taken along line 3—3 of FIG. 1, an end elevation view and a bottom view of the device.

The device 1 comprises two components: a rigid, plastic body and a floating pin 13. Two parallel openings 7, 9 serving as a plug receptacle are cut in a face of the body, near to one end. A groove 5 is formed in the bottom face of the body under the parallel openings 7, 9 to receive the third prong of a grounded type power plug.

The receptacle parallel openings 7, 9 extend into an internal box-shaped cavity 15 in the body, and are fixed in length so that the tips of inserted plug prongs with their tip holes 14 will extend beyond the openings and into the cavity 15. This is done to assure direct internal access to the prong tip holes.

A tubular axial first passage 11 is cut or formed along the approximate longitudinal axis of the body and aligned so that the passage axis will pass through a location coincident with the position of the prong tip holes 14 of any inserted plug prongs. A floating pin 13 fits into the first passage 11 and is in a position to slide into or out of any inserted plug prong tip holes, being sized in length and diameter to engage both the prongs for locking or unlocking.

A tubular second passage 3 is bored through the body in a direction that intersects the first passage 11 which contains the pin 13, passes through it. Thus, when the second passage 3 is empty and the device is tilted on end, the pin 13 is able to fall away from the receptacle openings 7, 9 and lie across the second passage 3 intersection.

In use, a power plug, either two prong or three prong, can be inserted only when the pin 13 has been previously caused to fall away from the prong tip holes and is lying across the intersection of the second passage 3. The device can be made to secure the plug by rotating the device 180 degrees, which causes the pin 13 to fall, enter and engage the plug prong tip holes 14. A wire rope cable, padlock shackle or shaft can then be made to pass through the second passage 3, blocking the first passage and so preventing the pin from sliding out of the prong tip holes.

Figure 6:
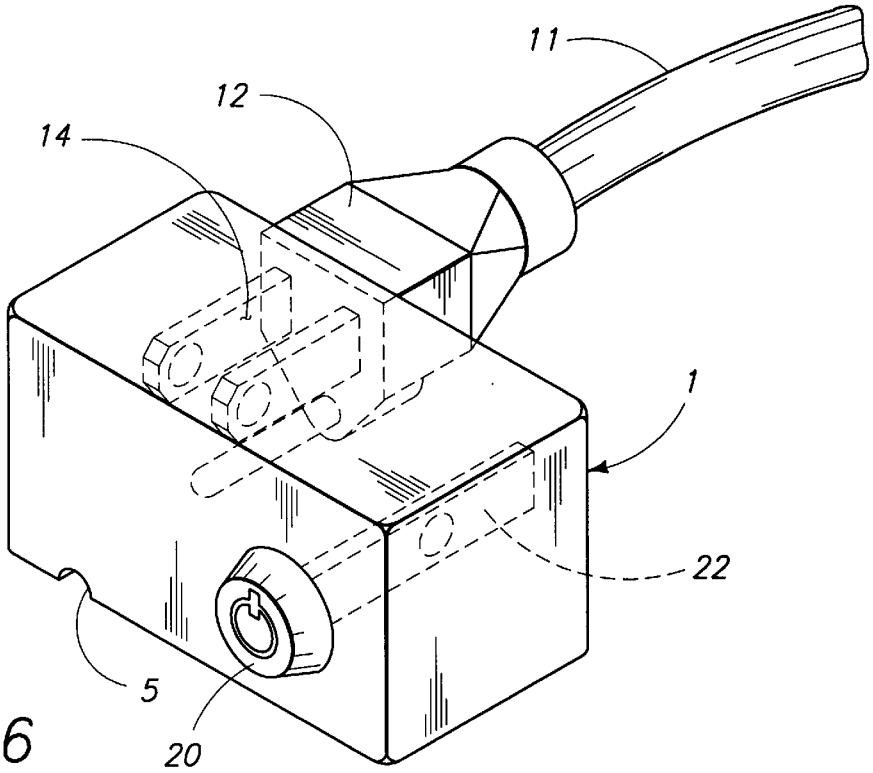
FIG. 6 is a perspective view of an alternate embodiment plug lock device according to the present invention, particularly showing an equipment power cord three-pronged plug connected to the device and an installed cam lock for locking the plug to the device.

There are device applications where it is desired only to prevent unauthorized use of an electrical equipment. This can be done by using an alternate embodiment of the invention device which is depicted in FIG. 6 with a three pronged plug 12 inserted in the device 1. As shown in FIG. 6, and in the partial cross-section views FIGS. 7 and 8, a cam lock 20 is added to the device, and fastened to a second passage 3 opening having a diameter adapted to seat the cam lock at one end, with its locking member 22 extending inside the second passage 3.

The remainder of the device is exactly as described earlier, with the exception of an additional portion that closes the normally open distal end of the second passage 3.

Figure 8:
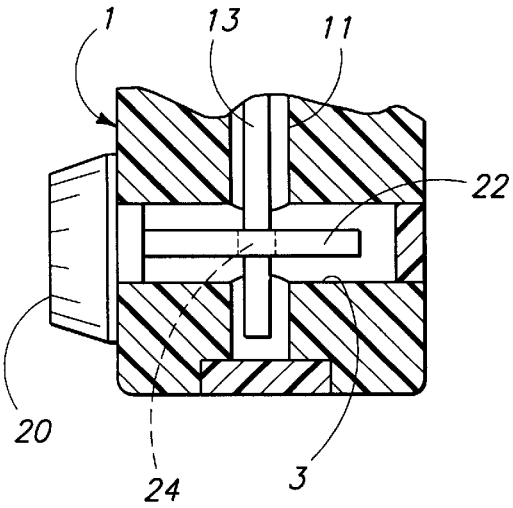
FIG. 8 is a partial, cross-section plan view of the alternate embodiment device, showing the cam lock locking member rotated to its open, unlocked position.
Figure 7:
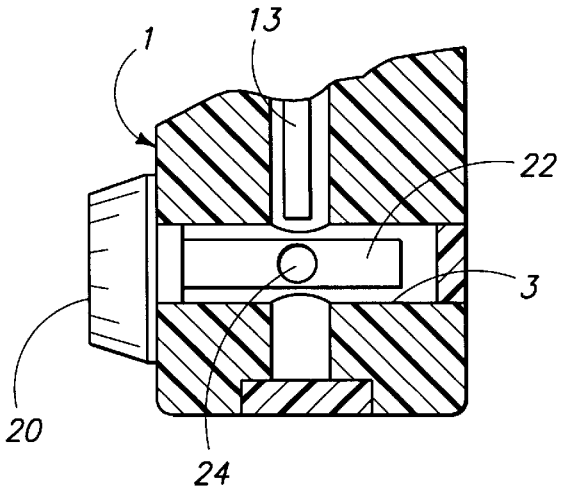
FIG. 7 is a partial, cross-section plan view of the alternate embodiment device, particularly showing the cam lock, locking member in its locked position, preventing the central locking pin from falling away from the plug prongs and freeing the prongs.

FIGS. 7 and 8 show how the cam lock 20 locks and unlocks the device. The locking member 22 includes a hole 24 that is sized and located so that the pin 13 can easily fall through it. In FIG. 7, the cam locking member 22 has been rotated so that it presents an edge to the end of the pin 13, blocking the pin 13 movement and thus locking the electric power plug in the device. FIG. 8 shows the locking member 22 rotated 90 degrees so that the pin 13 falls through the hole 24 in the member 22, unlocking the device and allowing an inserted power plug to be withdrawn.

Both the preferred and alternate embodiments of the device as described above are simply operated devices and may be used in may different applications including securing a small power transformer at the end of a power line instead of a standard two prong or three prong plug.

The device is simple in construction, has a minimal number of components, is small in size and low in cost.

From the foregoing description, it is believed that the preferred and alternate embodiments achieve the objects of the present invention. Various modifications and changes may be made to the electric power plug device described above which are apparent to those skilled in the art. These alternatives and modifications are considered to be within the scope of the appended claims and are embraced thereby.

What is claimed is:

1. A locking device for securing an electric cord power plug or other plug device that is connected to an electric powered equipment, said locking device comprising:

(a) a rigid plastic body having a rectangular box-like shape, said body having a generally planar front surface, back surface, top surface and bottom surface, said body incorporating and including the following features:

a rectangular shaped box cavity located inside one half of said body, extending from near one end of the device;

two vertical parallel slot openings in said front surface, cut through to communicate with said cavity and having a length extending to the center longitudinal axis of said body, said slot openings being sized and spaced apart to receive two parallel prongs projecting from a power plug, each of said parallel prongs having a first hole in its tip, one of said slot openings being slightly wider and taller than the other to allow for a non-grounded plug having only two prongs;

a groove formed in said bottom surface underneath and between said slot openings, and extending across the width of said body, said groove being sized to receive a ground prong, said groove together with said parallel slot openings forming an electrical plug receptacle;

a straight, tubular first passage located along the approximate longitudinal axis of said body and extending from near one end of said body to near its distal end, said first passage being aligned so that it passes through the ends of said parallel slots at a location coincident with the position of said first hole in each of said prongs when said prongs are inserted in said slots; and, a straight, tubular second passage bored through said body and intersecting said first passage at an angle of approximately 90 degrees, said second passage having a diameter sufficient to allow passing through a wire cable, shaft or padlock shackle, said second passage being located close to the body end furthest from said plug receptacle; and (b) a floating pin located in said first passage in said body, said pin having a length sufficient to extend across and beyond both said slot openings, and a diameter sized to pass easily through said first hole in said prongs;

said pin falling away from said slot openings when said body is turned with its end nearest to said second passage, titled downwards, allowing insertion of a power plug in said receptacle; said pin passing through said first hole in each of said parallel prongs, and remaining in position across said prongs when said body is turned with its receptacle end downwards, said pin being prevented from moving out of said parallel prongs when a wire cable, a shaft or a padlock shackle is passed through and held within said second passage in said body, effectively locking said power plug to said body.

2. A locking device for securing an electric cord power plug or other plug device that is connected to an electric powered equipment, said locking device comprising:

(a) a rigid plastic body having a rectangular box-like shape, said body having a generally planar front surface, back surface, top surface and bottom surface, said body incorporating and including the following features:

a rectangular shaped box cavity located inside one half of said body, extending from near one end of the device;

two vertical parallel slot openings in said front surface, cut through to communicate with said cavity and having a length extending to the center longitudinal axis of said body, said slot openings being sized and spaced apart to receive two parallel prongs projecting from a power plug, each of said parallel prongs having a first hole in its tip, one of said slot openings being slightly wider and taller than the other to allow for a non-grounded plug having only two prongs;

a groove formed in said bottom surface underneath and between said slot openings, and extending across the width of said body, said groove being sized to receive a ground prong, said groove together with said parallel slot openings forming an electrical plug receptacle;

a straight, tubular first passage located along the approximate longitudinal axis of said body and extending from near one end of said body to near its distal end, said first passage being aligned so that it passes through the ends of said parallel slots at a location coincident with the position of said first hole in each of said prongs when said prongs are inserted in said slots; and, a straight, tubular second passage bored through said body and intersecting said first passage at an angle of approximately 90 degrees, said second passage having an opening diameter sufficient to seat a cam lock, said second passage being located close to the body end furthest from said plug receptacle;

(b) a floating pin located in said first passage in said body, said pin having a length sufficient to extend across and beyond both said slot openings, and a diameter sized to pass easily through said first hole in said prongs; and (c) a cam lock mounted on said body at one end of said second passage, said lock having a rotatable locking member that extends into said second passage beyond the intersection of said first passage with said second passage, said locking member having a second hole that is located to be directly centered in said intersection and can be rotated to closely match the intersection openings of said first passage, so that access to the end of said first passage is unobstructed; said locking member able to be rotated by a key in said cam lock, causing said locking member to move to an angular position that blocks said first passage and said pin at said intersection, preventing movement by said pin out of said first hole in said prongs when a power plug has been inserted in said plug receptacle and effectively locking said power plug to said body;

said pin falling away from said slot openings when said cam lock is turned by a key to the open position, and said body is turned with its cam lock end titled downwards, allowing removal or insertion of a power plug in said receptacle; said pin passing through said first hole in each of said parallel prongs, and remaining in position across said prongs when said body is turned with its receptacle end downwards, said pin being prevented from moving out of said parallel prongs when said cam lock is turned by a key to a passage closed or blocking position.

3. A locking device for securing an electric cord power plug or other plug device that is connected to an electric powered equipment, said locking device comprising:

an elongated, rigid plastic body having at least one planar surface and a thickness sufficient to fully seat an electric power plug, said body including:

a plug receptacle formed in said planar surface adapted to receive the three prongs of a grounded type electrical plug or the two prongs of an ungrounded electrical plug, two of said prongs projecting in parallel and having a first hole in their tips;

first means for sliding engagement of said prongs when inside said receptacle, said first means including a tubular first passage located along the approximate longitudinal axis of said body and extending from near one end of said body to near its distal end, said first passage being aligned so that it passes through said receptacle at a location coincident with the position of said first hole in each of said prongs when said prongs are inserted in said receptacle; said first passage including therein a floating pin having a diameter sized to pass slidingly through said first hole in each of said prongs, and having a length sufficient to ensure continued engagement of both said prongs having tip holes when said pin is caused by gravity to fall inside said first passage towards said prongs; and second means for locking and securing an electric cord plug to said device, said second means including a straight, tubular second passage bored through said body and intersecting said first passage according to said first means at an angle of approximately 90 degrees, said second passage being located close to the body end furthest from said receptacle, said second passage in said body cooperating with, and enabling a wire cable to be inserted therein, blocking said first passage and said pin, thereby preventing said pin from falling out of engagement with the prongs of an electric cord plug that is seated in said receptacle, and locking and securing said plug to said device.

4. The device according to claim 3, wherein said second means for locking and securing an electric cord plug to said device includes a straight, tubular second passage bored through said body and intersecting said first passage according to said first means at an angle of approximately 90 degrees, said second passage being located close to the body end furthest from said receptacle, said second passage in said body cooperating with, and enabling a shaft to be inserted therein, blocking said first passage and said pin, thereby preventing said pin from falling out of engagement with the prongs of an electric cord plug that is seated in said receptacle, and locking and securing said plug to said device.

5. The device according to claim 3, wherein said second means for locking and securing an electric cord plug to said device includes a straight, tubular second passage bored through said body and intersecting said first passage according to said first means at an angle of approximately 90 degrees, said second passage being located close to the body end furthest from said receptacle, said second passage in said body cooperating with, and enabling a padlock shackle to be inserted therein, blocking said first passage and said pin, thereby preventing said pin from falling out of engagement with the prongs of an electric cord plug that is seated in said receptacle, and locking and securing said plug to said device.

6. The device according to claim 3, wherein said second means for locking and securing an electric cord plug to said device includes:

a straight, tubular second passage bored through said body and intersecting said first passage according to said first means at an angle of approximately 90 degrees, said second passage having an opening diameter sized to seat a cam lock, said second passage being located close to the body end furthest from said receptacle; and a cam lock mounted on said body at one end of said second passage, said lock having a rotatable locking member that extends into said second passage beyond the intersection of said first passage with said second passage, said locking member having a second hole that is located to be directly centered in said intersection and can be rotated to closely match the intersection openings of said first passage, so that access to the end of said first passage is unobstructed; said locking member able to be rotated by a key in said cam lock, causing said locking member to move to an angular position that blocks said first passage and said pin at said intersection, preventing movement by said pin out of said first hole in said prongs when a power plug has been inserted in said plug receptacle and effectively locking said power plug to said body.

* * * * *